US011223171B2

(12) United States Patent
Zhang

(10) Patent No.: US 11,223,171 B2
(45) Date of Patent: Jan. 11, 2022

(54) MULTIFUNCTIONAL PLUG AND POWER ADAPTER

(71) Applicant: SHENZHEN YONGMINGSHANDER TECHNOLOGY & DEVELOPMENT CO., LTD., Shenzhen (CN)

(72) Inventor: Deyong Zhang, Guangdong (CN)

( * ) Notice: Subject to any disclaimer, the term of this patent is extended or adjusted under 35 U.S.C. 154(b) by 0 days.

(21) Appl. No.: 17/035,649

(22) Filed: Sep. 28, 2020

(65) Prior Publication Data

US 2021/0218205 A1 Jul. 15, 2021

(30) Foreign Application Priority Data

Jan. 13, 2020 (CN) ..... 202010035180.2

(51) Int. Cl.
*H01R 27/00* (2006.01)
*H01R 31/06* (2006.01)
*H01R 13/502* (2006.01)

(52) U.S. Cl.
CPC ..... *H01R 27/00* (2013.01); *H01R 13/5025* (2013.01); *H01R 31/06* (2013.01)

(58) Field of Classification Search
CPC .... H01R 13/5025; H01R 27/00; H01R 29/00; H01R 31/06
See application file for complete search history.

(56) References Cited

U.S. PATENT DOCUMENTS 5,967,807 A * 10/1999 Wu ..... H01R 31/06 439/131
9,166,351 B1 * 10/2015 Wang ..... H01R 24/66
9,362,765 B1 * 6/2016 Blaszczak ..... H01R 31/065

* cited by examiner

*Primary Examiner* — Briggitte R. Hammond

(57) ABSTRACT

A multifunctional plug, including a main body and a pin piece. The main body is provided with a holding slot for holding the pin piece. The pin piece includes a pin and a rotating shaft. The pin can rotate out of the holding slot with the rotating shaft as the rotating center, and the pin can extend into the slot of other plug and is conductive connection with the plug piece assembly of the other plug. The main body is provided with a first clamping portion, and further includes the first conductive spring piece fixed in the main body. A power adapter, including a multifunctional plug, other plug and a housing. The multifunctional plug is fixed on the housing, and the other plug is detachable and clamped on the multifunctional plug.

10 Claims, 10 Drawing Sheets

MULTIFUNCTIONAL PLUG AND POWER ADAPTER

CROSS REFERENCE TO RELATED DISCLOSURE

This disclosure claims priority benefit of Chinese Patent disclosure No. CN202010035180.2, filed on Jan. 13, 2020, and the entire contents of which are incorporated herein by reference.

TECHNICAL FIELD

The present disclosure relates to the technical field of plugs, in particular to a multifunctional plug and a power adapter.

BACKGROUND

With the development of economy and the improvement of living standards, more and more people frequently travel abroad, take vacations or work. In the process of business trip or travel, they will take mobile phones, computers, cameras and other electronic equipment with them. In order to maintain the normal use of these electronic equipment, it is necessary to charge the electronic equipment.

At present, the interfaces of sockets in many countries are different, such as Chinese national standard sockets, American national standard sockets, etc., and their structures are not the same. As a result, the electrical appliances produced in one country or region do not fit to the power plug and socket standards of another country or region, so the commonly used plugs cannot be switched to use between countries.

SUMMARY

The objective of the present disclosure is to provide a multifunctional plug and a power adapter with good universality.

The technical solution adopted by the multifunctional plug disclosed by the present disclosure is as follows:

A multifunctional plug, which is used to realize multi-plug switching with other plug, including a main body and a pin piece, wherein the main body is provided with a holding slot for the pin piece, the pin piece comprises a pin and a rotating shaft arranged at a tail end of the pin, the pin is able to rotate out of the holding slot with the rotating shaft as a rotation center, and the pin is able to extend into a slot of the other plug and conductive connected with a pin assembly of the other plug; the main body is provided with a inserting portion; further includes a conductive contact piece is fixed in the main body, one end of the conductive contact piece is elastically abutted on the tail end of the pin and the other end extends out of the main body to form an output contact.

As a preferred solution, the inserting portion is formed in an area between two pins in the holding slot.

As a preferred solution, the inserting portion is a T-shaped block protruding from a bottom surface of the holding slot.

As a preferred solution, the inserting portion includes a protruded portion protruding from a bottom surface of the holding slot and a T-shaped slot arranged on the protruded portion.

As a preferred solution, two sides of the inserting portion close to the pin are protruded to form a first convex bar.

As a preferred solution, an inner bottom surface of the holding slot is protruded to form a second convex bar.

As a preferred solution, an inner wall of the holding slot is recessed to form a first clamping slot.

As a preferred solution, a bottom surface of the T-shaped slot is recessed to form a positioning slot.

As a preferred solution, the rotating shaft is integrally molded at the tail end of the pin through injection molding.

Further, the present disclosure is to provide a power adapter, including a multifunctional plug, other plug and a housing, the multifunctional plug is fixed on the housing, and the other plug is detachable and clamped on the multifunctional plug.

The present disclosure discloses a multifunctional plug and a power adapter, which has the following advantageous effects: when the multifunctional plug needs to be externally connected, the pin piece is rotated until it is contained in the holding slot, and the conductive contact piece always contacts the pin piece in the process. The other plug is connected through the inserting portion, and the pin of the pin piece is inserted into the slot of the other plug to conduct with the pin assembly of the other plug. At this time, the external current can flow in from the pin assembly and flow out through the output contact of the pin piece and the conductive contact piece. Therefore, the multifunctional plug allows users to select the corresponding plug according to actual requirement, with strong adaptability and good universality.

DETAILED DESCRIPTION OF THE EMBODIMENTS

Figure 1:
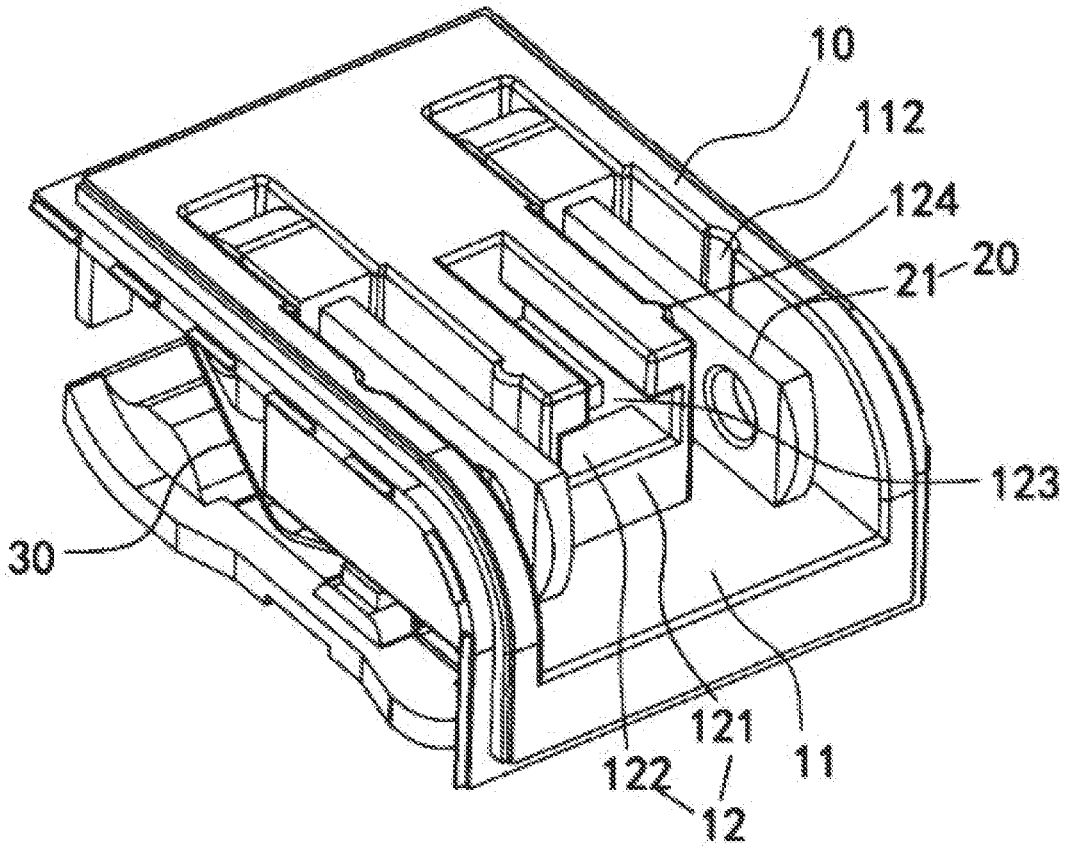
FIG. 1 is a structural view of a multifunctional plug of the present disclosure.
Figure 2:
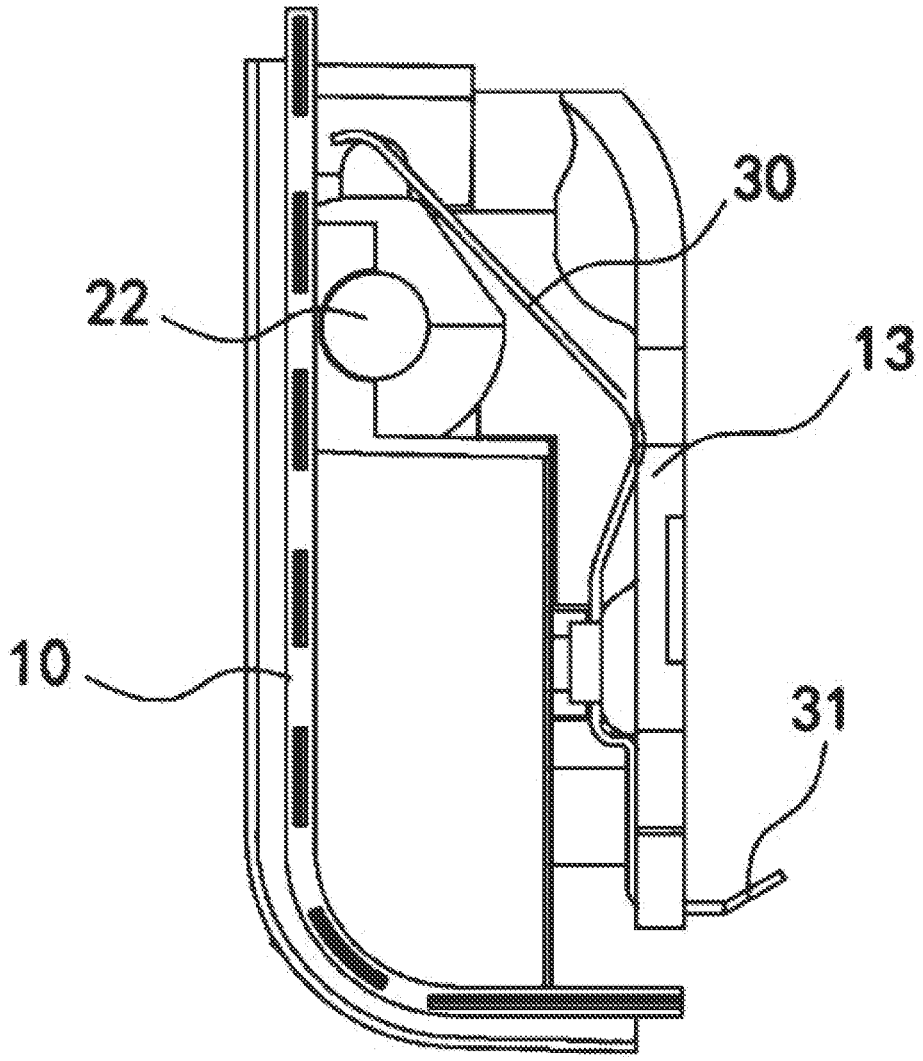
FIG. 2 is a lateral view of the multifunctional plug of the present disclosure.
Figure 3:
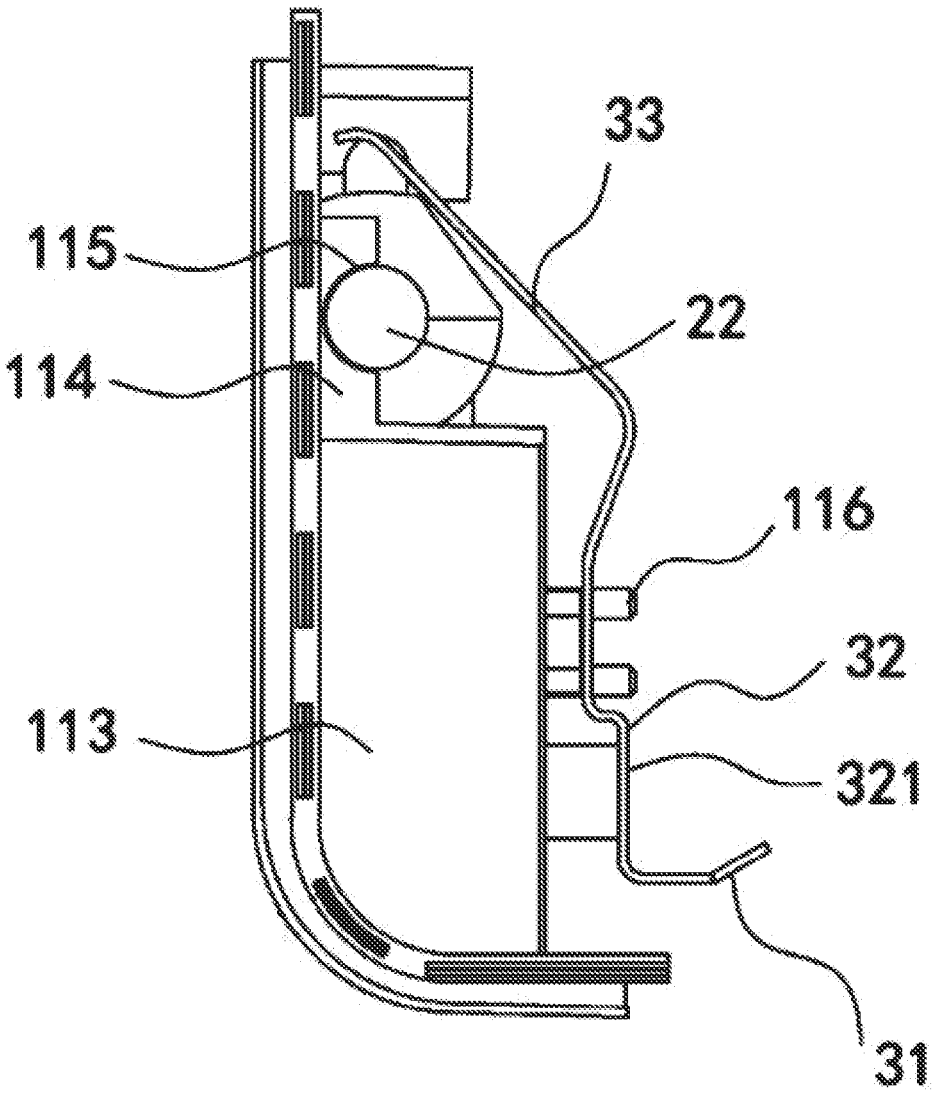
FIG. 3 is a lateral view of the multifunctional plug of the present disclosure after removing the cover.
Figure 4:
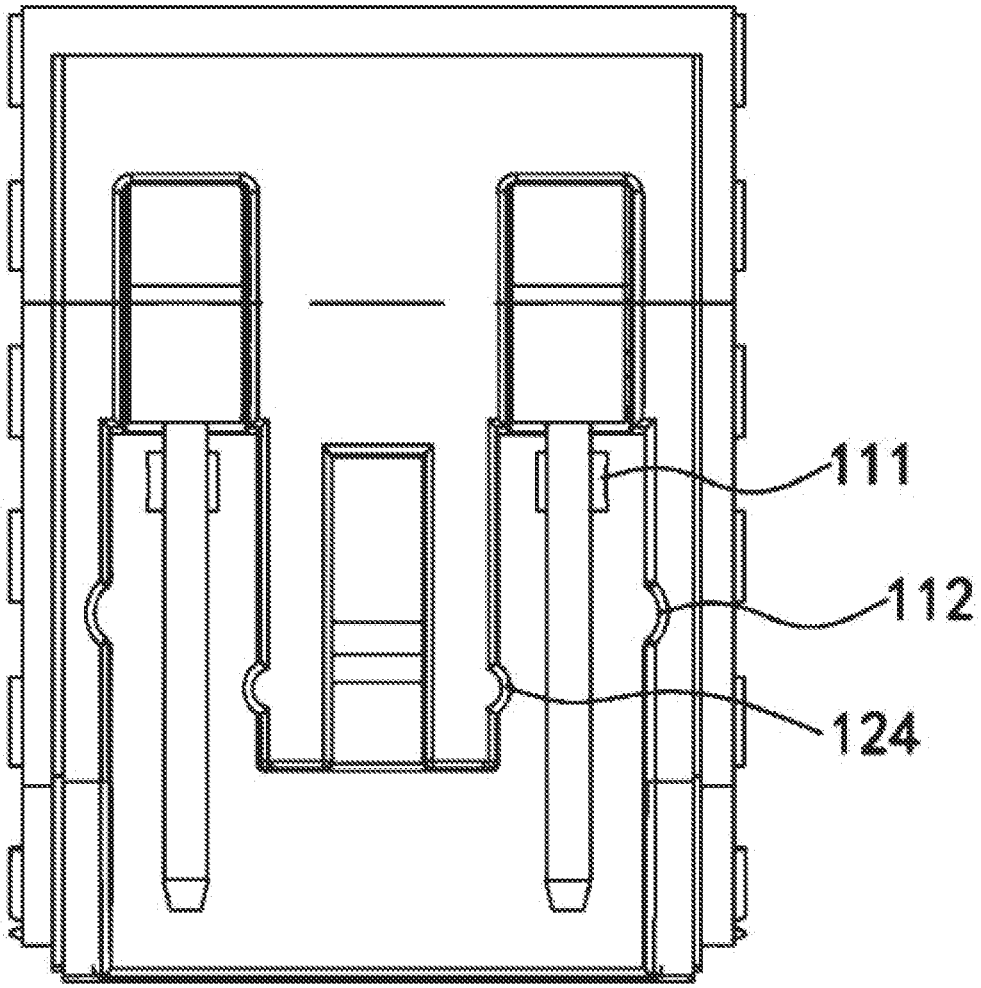
FIG. 4 is a top view of the multifunctional plug of the present disclosure.
Figure 5:
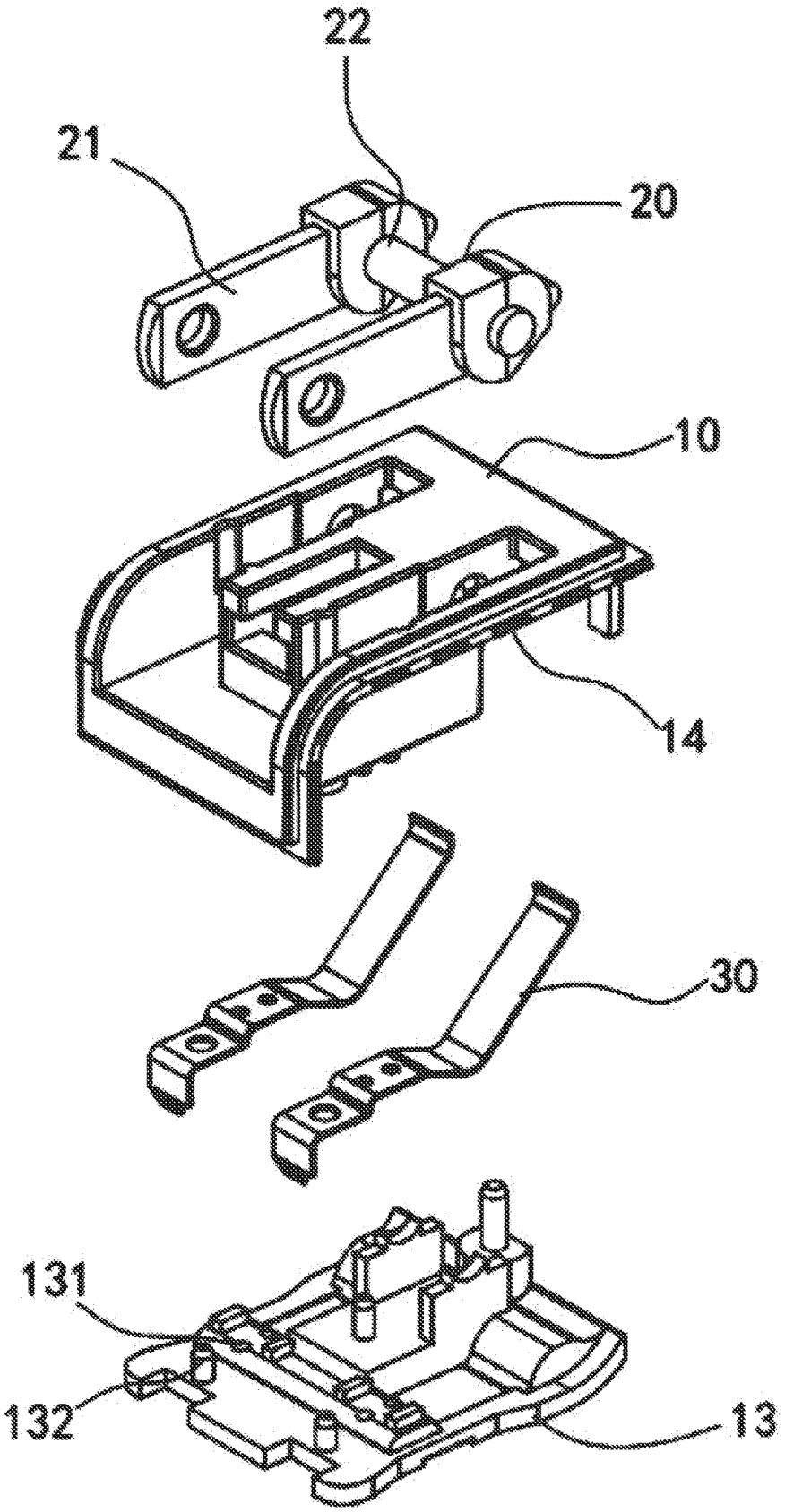
FIG. 5 is the exploded perspective view of the multifunctional plug of the present disclosure.
Figure 6:
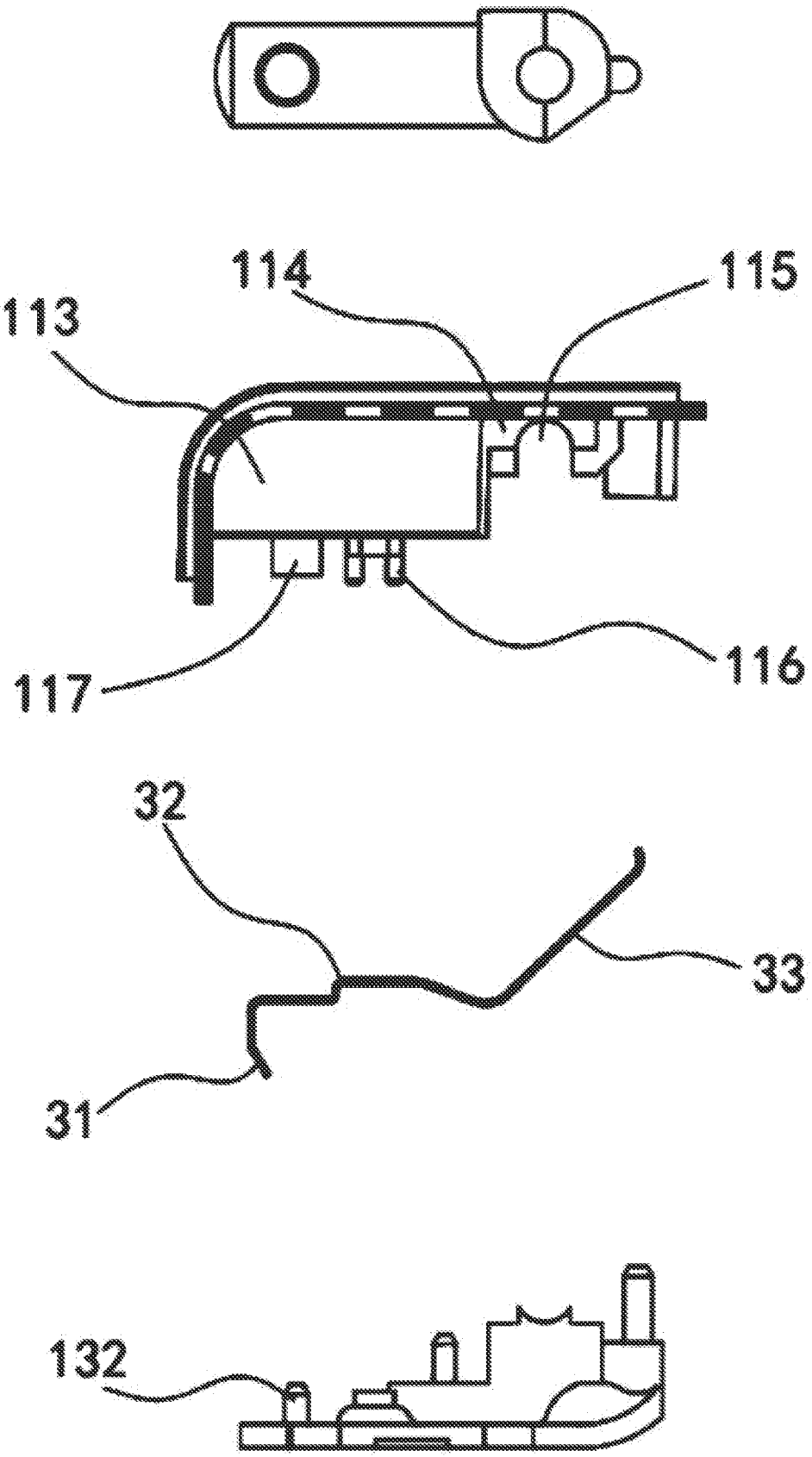
FIG. 6 is the lateral exploded view of the multifunctional plug of the present disclosure.

The present disclosure will be further elaborated and illustrated below in conjunction with specific embodiments and the accompanying drawings of the specification:

Please refer to FIG. 1, a multifunctional plug, which is used to cooperate with other plug to realize multi-plug switching, includes a main body 10 and a pin piece 20.

Referring to FIGS. 1-6, the main body 10 is provided with a holding slot 11 for holding the pin piece 20. The pin piece 20 includes a pin 21 and a rotating shaft 22 arranged at the tail end of the pin 21. The pin 21 can rotate out of the holding slot 11 with the rotating shaft 22 as the rotating center. The pin 21 has two pins which are connected by the rotating shaft 22. The rotating shaft 22 is integrally molded at the tail end of the pin 21 by injection molding. The pin 21 can be inserted into the slot 61 of the other plug and conductive connected with the pin assembly of the other plug.

Specifically, the holding slot 11 is arranged on the front side of the main body 10. The holding slot 11 includes a front end slot 113 for holding the pin 21 and a rear end slot 114 for holding the rotating shaft 22. The slot bottom and part of the side wall of the rear end slot 114 are removed, and a semicircular clamping hole 115 for installing the rotating shaft 22 is arranged on the remaining side wall, and the pin 21 extends from the rear end slot 114 into the front end slot 113 until the rotating shaft 22 is aligned with the semicircular clamping hole 115.

The main body 10 is provided with a inserting portion 12 which is formed in an area between two pins 21 in the holding slot 11. The inserting portion 12 is used to cooperate with the inserting piece of the other plug to realize the clamping connection between the multifunctional plug and the other plug.

The inserting portion 12 includes a protruded portion 121 protruding from the bottom surface of the holding slot 11 and a T-shaped slot 122 arranged on the protruded portion 121. The bottom surface of the T-shaped slot is recessed to form a positioning slot 123. And the positioning slot 123 is matched with the positioning block 621 of the inserting piece 62 in the other plug to limit the position of the other plug in the length direction within the T-slot 122.

Two sides of the inserting portion 12 close to the pin 21 is protruded to form a first convex bar 124. The inner bottom surface of the holding slot 11 is protruded to form a second convex bar 111. The inner wall of the holding slot 11 is recessed to form the first clamping slot 112.

Figure 7:
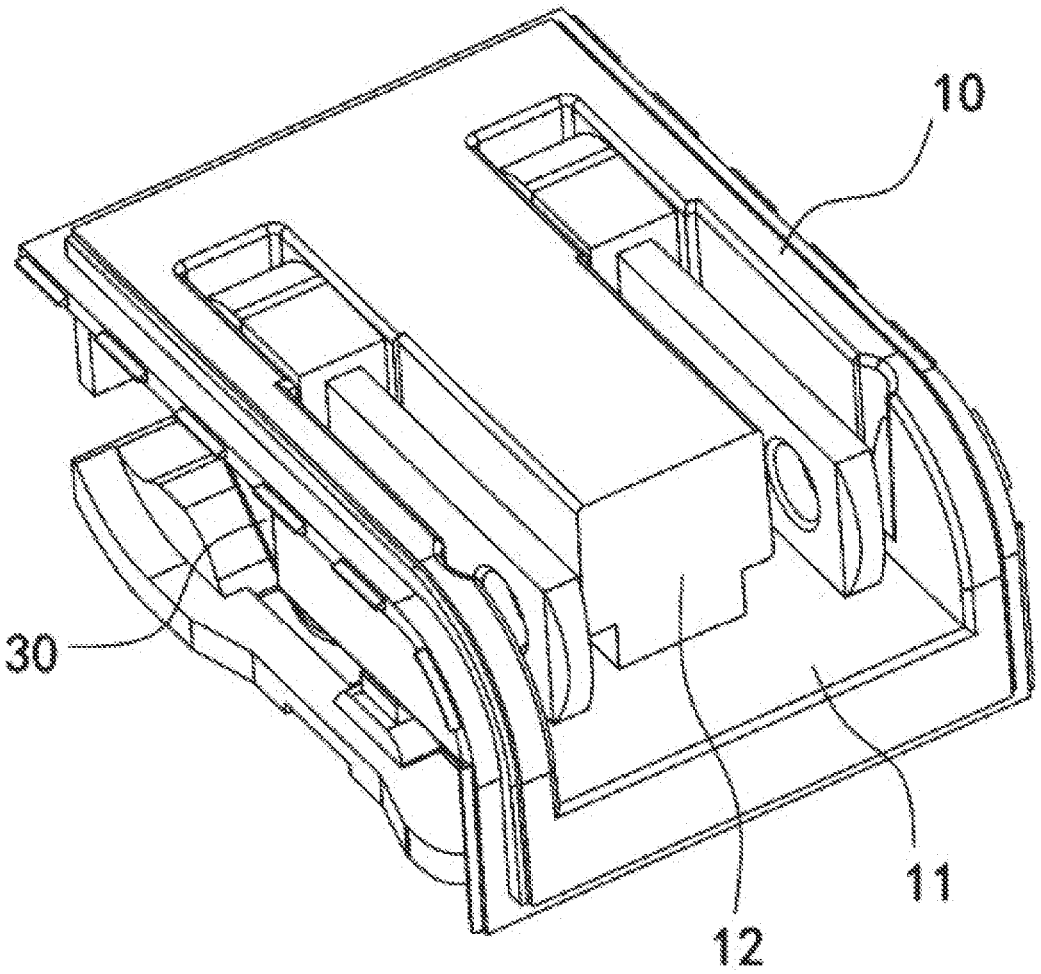
FIG. 7 is another structural view of the multifunctional plug of the present disclosure.

Referring to FIG. 7, in another embodiment, the inserting portion 12 is a T-shaped block protruding from the bottom surface of the holding slot 11.

Please refer to FIGS. 1-6 again. The multifunctional plug also includes a conductive contact piece 30 which is fixed in the main body 10. One end of the conductive contact piece 30 is elastically abutted on the tail end of the pin, and the other end extends out of the main body 10 to form an output contact 31.

The main body 10 also includes a cover 13, which is fixed on the back of the main body 10, and is used to fix the conductive contact piece 30 on the main body 10. Specifically, there provides two of conductive contact piece 30, both of which are arranged on the back of the main body 10, and the conductive contact piece 30 includes a positioning section 32 and an elastic section 33 connected with each other.

A positioning clamp post 116 is formed on the back of the holding slot 11, a clamping hole corresponding to the positioning clamp post 116 is formed on the positioning section 32, and a positioning clamp hole 131 corresponding to the positioning clamp post 116 is arranged on the cover 13. Wherein, the positioning clamp post 116 is in interference fit with the positioning clamp hole 131. The back of the holding slot 11 is protruded to form a concave boss 117, the top surface of the concave boss 117 is provided with a positioning hole, and the cover 13 is also provided with a positioning post 132, which is in interference fit with the positioning hole. When the cover 13 is installed, the conductive contact piece 30 is fixed on the back of the holding slot 11 through the positioning clamp post 116, the cover 13 is covered on the conductive contact piece 30, and the positioning clamp post 116 is clamped into the positioning clamp hole 131 and the positioning post 132 is clamped into the positioning hole.

The output contact 31 is formed at one end of the positioning section 32, and the other end of the positioning section 32 is connected with the elastic section 33. The elastic section 33 bends and extends towards the pin piece 20, and the end of the elastic section is abutted on the pin 21. When pin 21 is rotated, the elastic section 33 remains electrically connected with pin 21 all the time.

When the multifunctional plug needs to be connected externally, the pin piece 20 is rotated until it is contained in the holding slot 11, and the conductive contact piece 30 always contacts the pin piece 20 during the process. The other plug is connected through the inserting portion 12, and the pin of the pin piece 20 is inserted into the slot of the other plug to conduct with the pin assembly of the other plug. At this time, the external current can flow in from the pin assembly and flow out through the output contact 31 of the pin piece 20 and the conductive contact piece 30. Therefore, the multifunctional plug allows users to select the corresponding plug according to actual needs, with strong adaptability and good universality.

Figure 8:
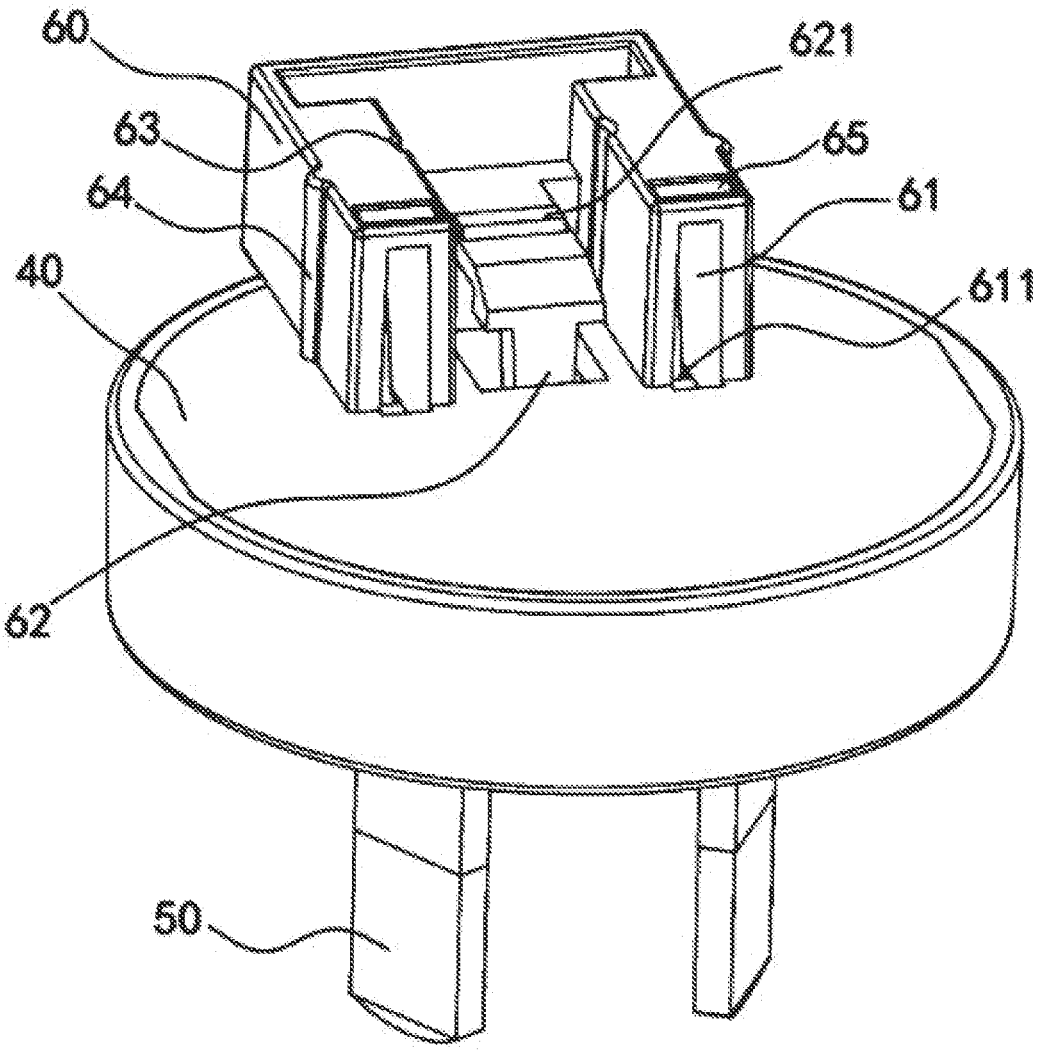
FIG. 8 is a structural view of other plug of the present disclosure.
Figure 9:
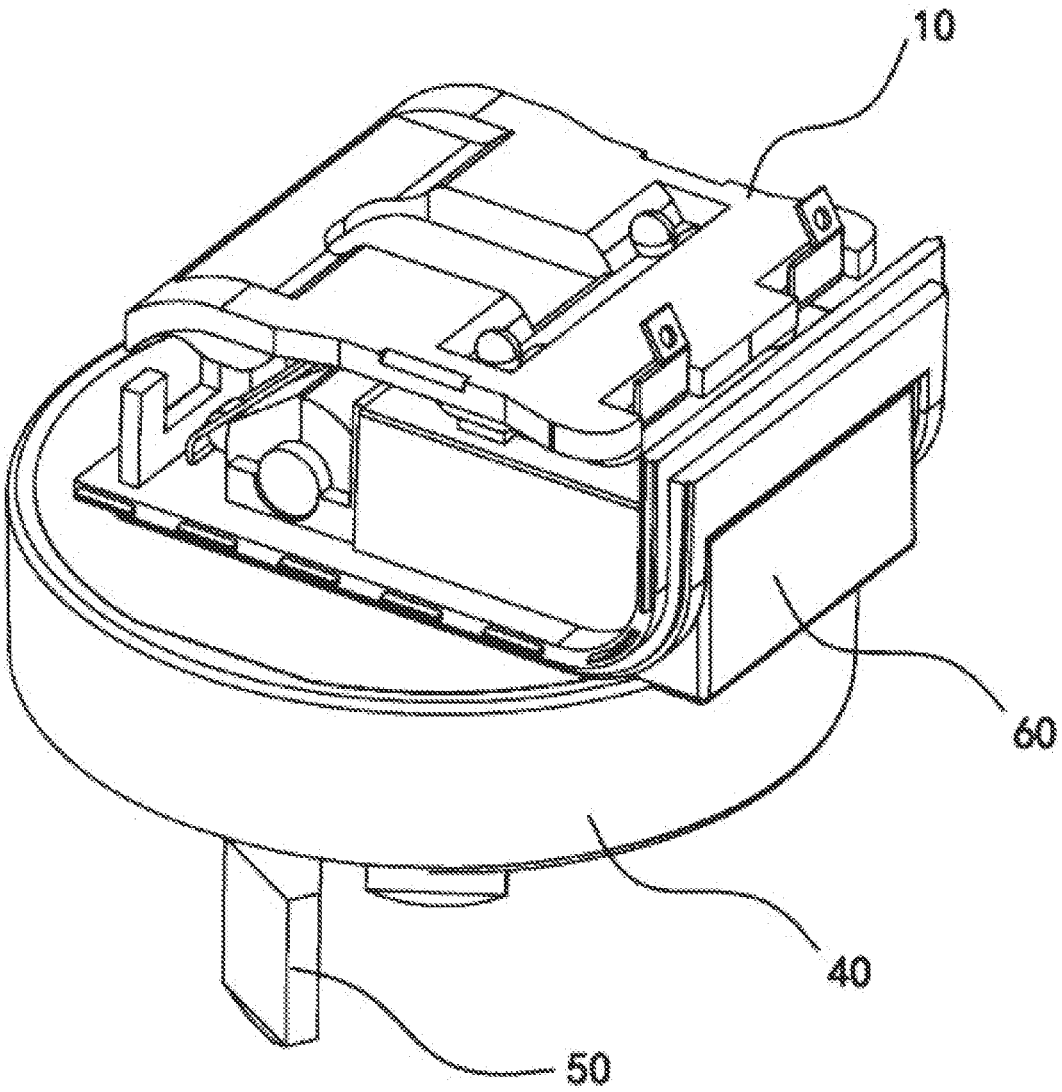
FIG. 9 is a structural view of the multifunctional plug and other plug of the present disclosure.

Refer to FIG. 8 and FIG. 9. For further illustration, the present disclosure discloses the other plug, the other plug includes a housing 40 and a pin assembly 50, and the pin assembly 50 is arranged on the housing 40.

The housing 40 is also provided with a plug-in structure, which includes a slot 61 and an inserting piece 62. The inserting piece 62 is formed in an area between the two slots 61. The inserting piece 62 is used for clamping with the inserting portion 12 on the multifunctional plug. Specifically, the inserting piece 62 includes a T-shaped block. The top surface of the T-shaped block is protruded slightly to form a positioning block 621. The positioning block 621 is matched with the positioning slot 123 to limit the position of the T-shaped block in the length direction of the T-shaped slot.

The housing 40 is protruded relative to the other side to form two bumps 60. Two sets of slots 61 are respectively arranged on a bump 60. The sum of the space size between the two bumps 60 and its own width size is equal to the width size of the holding slot 11. The bump 60 is located near the edge area on the opposite side of the housing 40 to leave enough space on the housing 40 to facilitate the placement of another plug.

The other plug also includes a second conductive spring piece 611, one end of the second conductive spring piece 611 is electrically connected with the pin assembly 50, and the other end extends into the slot 61 to form an elastic contact. When the inserting portion 12 is matched with the inserting piece 62, the pin of the pin piece 20 extends into the slot 61, contacts and conducts with the elastic contact.

One side of the two bumps 60 close to the inserting piece 62 is recessed to form the first limiting slot 63, and one side of the two bumps 60 far away from the inserting piece 62 is protruded to form the first convex rib 64. The top surface of the two bumps 60 is recessed to form the second limiting slot 65. When inserting, the inserting piece 62 extends into the T-shaped slot 122 of the inserting portion 12 until the positioning block 621 moves into the positioning slot 123. At the same time, the first convex bar 124 moves into the first limiting slot 63, the second convex bar 111 moves to the second limiting slot 65, and the first clamping slot 112 moves to the first convex rib 64, so as to improve the stability and reliability of the clamping.

In the above solution, the pin 20 is the pin of Chinese national standard.

Figure 10:
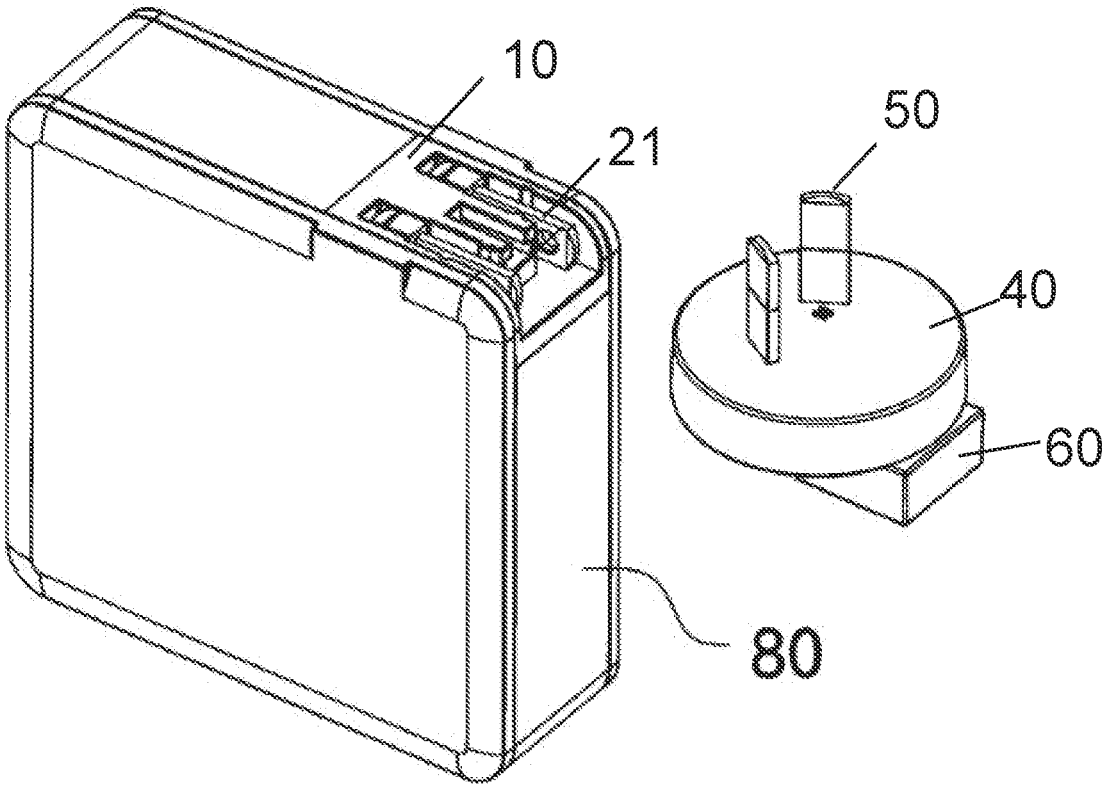
FIG. 10 is a structural view of the power adapter of the present disclosure.

Referring to FIG. 10, the present also discloses a power adapter, which includes a multifunctional plug, the other plug and the housing 80. The multifunctional plug is fixed on the housing 80, and the other plug is detachable and clamped on the multifunctional plug. The side edge of the main body 40 of the multifunctional plug is provided with a plurality of ultrasonic melting parts. After the multifunctional plug is installed on the housing 80, the ultrasonic melting parts are melted by ultrasonic wave, and the multifunctional plug is fixed on the housing 80.

When it is necessary to externally connect the multifunctional plug, the pin piece 20 of the multifunctional plug is rotated until it is contained in the holding slot 11. The holding slot 11 is aligned with the bump 60, and the bump 60 is pushed into the holding slot 11, so that the inserting piece 62 is engaged with the inserting portion 12. And at the same time, the pin piece 20 of the multifunctional plug extends into the slot 61 and is in conductive contact with the elastic contact in the slot 61, so that the pin piece 20 of the multifunctional plug is in conduction with the pin assembly 50. At this time, the external current can flow in from the second pin group and flow out through the second conductive spring piece, the pin piece 20 and the output contact 31 of the conductive contact 30 in sequence. Therefore, the multifunctional plug allows users to select the corresponding pins according to actual needs, with strong adaptability and good universality.

Finally, it should be noted that the above embodiments are only used to illustrate the technical solutions of the present disclosure, and not to limit the scope of the present disclosure. Although the present disclosure is described in detail with reference to the preferred embodiments, the ordinary skilled person in the art should understand that the technical solution of the present disclosure can be modified or equivalently replaced without departing from the essence and scope of the technical solution of the present disclosure.

What is claimed is:

1. A multifunctional plug, which is used to realize multiplug switching with an other plug, the multifunctional plug comprising a main body and a pin piece, wherein the main body is provided with a holding slot for the pin piece, the pin piece comprises a pin and a rotating shaft arranged at a tail end of the pin, the pin is able to rotate out of the holding slot with the rotating shaft as a rotation center, and the pin is able to extend into a slot of the other plug and conductively connected with a pin assembly of the other plug; the main body is provided with an inserting portion;

further comprising a conductive contact piece is fixed in the main body, one end of the conductive contact piece is elastically abutted on the tail end of the pin, and the other end extends out of the main body to form an output contact.

2. The multifunctional plug according to claim 1, wherein the inserting portion is formed in an area between two pins in the holding slot.

3. The multifunctional plug according to claim 2, wherein the inserting portion is a T-shaped block protruding from a bottom surface of the holding slot.

4. The multifunctional plug according to claim 1, wherein the inserting portion comprises a protruded portion protruding from a bottom surface of the holding slot and a T-shaped slot arranged on the protruded portion.

5. The multifunctional plug according to claim 4, wherein two sides of the inserting portion close to the pin are protruded to form a first convex bar.

6. The multifunctional plug according to claim 5, wherein an inner bottom surface of the holding slot is protruded to form a second convex bar.

7. The multifunctional plug according to claim 4, wherein an inner wall of the holding slot is recessed to form a first clamping slot.

8. The multifunctional plug according to claim 4, wherein a bottom surface of the T-shaped slot is recessed to form a positioning slot.

9. The multifunctional plug according to claim 4, wherein the rotating shaft is integrally molded at the tail end of the pin through injection molding.

10. A power adapter, comprising the multifunctional plug, the other plug according to claim 1 and a housing, the multifunctional plug is fixed on the housing, and the other plug is detachable and clamped on the multifunctional plug.

* * * * *